US008752717B2

(12) United States Patent
Bird et al.

(10) Patent No.: US 8,752,717 B2
(45) Date of Patent: Jun. 17, 2014

(54) BASE AND DIVIDER ASSEMBLY

(71) Applicants: Gregory M. Bird, Solon, OH (US); Gerald Matthew Szpak, Brecksville, OH (US); Paul Mueller, Wadsworth, OH (US)

(72) Inventors: Gregory M. Bird, Solon, OH (US); Gerald Matthew Szpak, Brecksville, OH (US); Paul Mueller, Wadsworth, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

(21) Appl. No.: 13/861,995

(22) Filed: Apr. 12, 2013

(65) Prior Publication Data

US 2013/0270204 A1 Oct. 17, 2013

Related U.S. Application Data

(60) Provisional application No. 61/623,280, filed on Apr. 12, 2012, provisional application No. 61/784,593, filed on Mar. 14, 2013.

(51) Int. Cl.
*A47F 1/04* (2006.01)
*A47B 57/00* (2006.01)

(52) U.S. Cl.
USPC ..... 211/59.3; 211/184

(58) Field of Classification Search
USPC ..... 211/59.2, 59.3, 184, 126.12, 126.2, 211/126.4, 183, 187; 108/60, 61; 312/61, 312/71
See application file for complete search history.

(56) References Cited

U.S. PATENT DOCUMENTS

| | | | | |
|---|---|---|---|---|
| 5,199,584 | A * | 4/1993 | Fowler et al. | 211/184 |
| 6,227,385 | B1 * | 5/2001 | Nickerson | 211/59.3 |
| 6,357,606 | B1 * | 3/2002 | Henry | 211/59.3 |
| 6,571,498 | B1 * | 6/2003 | Cyrluk | 40/661.03 |
| 6,651,828 | B2 * | 11/2003 | Dimattio et al. | 211/59.2 |
| 7,093,546 | B2 * | 8/2006 | Hardy | 108/60 |
| 7,395,938 | B2 * | 7/2008 | Merit et al. | 211/59.4 |
| 7,628,282 | B2 * | 12/2009 | Hardy | 211/59.3 |
| 7,641,057 | B2 * | 1/2010 | Mueller et al. | 211/59.3 |
| 7,784,623 | B2 | 8/2010 | Mueller et al. | |
| 7,913,861 | B2 | 3/2011 | Mueller et al. | |
| 7,931,156 | B2 * | 4/2011 | Hardy | 211/59.3 |
| 8,186,520 | B2 | 5/2012 | Schneider et al. | |
| 8,276,766 | B2 | 10/2012 | Rataiczak, III et al. | |
| 8,317,038 | B2 * | 11/2012 | Luberto et al. | 211/59.3 |
| 8,443,988 | B2 * | 5/2013 | Niederhuefner | 211/59.3 |
| 2001/0010302 | A1 * | 8/2001 | Nickerson | 211/59.3 |
| 2002/0108916 | A1 * | 8/2002 | Nickerson | 211/59.3 |
| 2004/0118794 | A1 * | 6/2004 | Hardy | 211/59.3 |
| 2004/0140278 | A1 | 7/2004 | Mueller et al. | |
| 2005/0092703 | A1 * | 5/2005 | Mueller et al. | 211/59.3 |
| 2005/0150847 | A1 * | 7/2005 | Hawkinson | 211/59.2 |

(Continued)

FOREIGN PATENT DOCUMENTS

| | | | |
|---|---|---|---|
| EP | 2 457 472 | A1 | 5/2012 |
| WO | WO 2010071943 | A1 * | 7/2010 |

*Primary Examiner* — Joshua Rodden
(74) *Attorney, Agent, or Firm* — Fay Sharpe LLP

(57) ABSTRACT

A base and divider assembly includes an elongated base portion and an elongated divider portion which is adapted to be selectively coupled to the base portion. The divider portion includes a plurality of spaced first connection elements extending along a longitudinal axis of the divider portion, and the base portion includes a plurality of spaced second connection elements extending along a longitudinal axis of the base portion. The first and second connection elements are adapted to cooperate so that the divider portion can be selectively mounted to the base portion.

20 Claims, 15 Drawing Sheets

(56) References Cited

U.S. PATENT DOCUMENTS

| | | | | |
|---|---|---|---|---|
| 2006/0186064 | A1* | 8/2006 | Merit et al. | 211/59.3 |
| 2007/0090068 | A1* | 4/2007 | Hardy | 211/59.3 |
| 2007/0138114 | A1* | 6/2007 | Dumontet | 211/59.3 |
| 2007/0158281 | A1* | 7/2007 | Hardy | 211/59.3 |
| 2008/0156752 | A1* | 7/2008 | Bryson et al. | 211/59.3 |
| 2009/0184069 | A1* | 7/2009 | Hardy | 211/59.3 |
| 2010/0089847 | A1* | 4/2010 | Rataiczak et al. | 211/59.3 |
| 2011/0174750 | A1* | 7/2011 | Poulokefalos | 211/59.3 |
| 2011/0215060 | A1* | 9/2011 | Niederhuefner | 211/59.3 |
| 2012/0111813 | A1 | 5/2012 | Hardy | |
| 2013/0062295 | A1* | 3/2013 | Bird et al. | 211/59.3 |
| 2013/0112640 | A1* | 5/2013 | Desmond | 211/153 |

* cited by examiner

BASE AND DIVIDER ASSEMBLY

This application claims the benefit of U.S. Ser. No. 61/784,593 filed on Mar. 14, 2013 and of U.S. Ser. No. 61/623,280 filed on Apr. 12, 2012.

BACKGROUND

The present disclosure pertains to a merchandising system. More specifically, the disclosure relates to a base and divider assembly employed in a forward feeding display merchandising system for storing and displaying merchandise of a variety of shapes and sizes and automatically delivering the merchandise to the front of a shelf. The merchandising system can be removably attached to an associated shelf and is configured to organize merchandise on the shelf.

Shelving is used extensively for stocking and storing products or merchandise in a variety of stores, such as grocery stores, drug stores and the like. Most consumer product stores contain fixed shelving which is arranged back to back between isle ways. The nature of the fixed shelves makes rotation of the products on the shelf a difficult proposition. It is desirable to move older stock to the front of the shelf and position newer stock behind the older stock so that the older stock is sold first. For a number of important merchandising considerations, it is desirable that the merchandise be displayed at the front of the shelf so that a customer is induced to purchase the forward-most such article of merchandise. For example, if the products are perishable, are subject to becoming stale (cigarettes, fruit juices, dairy products and the like fall into this category), it is important that the articles be removed following a first in, first out system to maintain freshness. Moreover, if the merchandise is not displayed at the front of the shelf, it may not catch the shopper's eye and that could cost the merchant sales.

Forward feed devices are employed to automatically move an item forward on a shelf as the one before it in a column of merchandise is removed from the shelf. These devices generally fall into three categories. The first category pertains to inclined tracks which rely on gravity to feed, slide or roll products forward on the shelf. Gravity feeding may be unpredictable in that various materials or packages slide more easily than others because of different weights and frictional interfaces between the products and the track. The second category employs conveyor belts which still use gravity to effect a forward movement. These devices are typically cumbersome, expensive and complicated due to the need to properly tension the track and the conveyor belts. The third category uses spring biased pusher paddles to feed the product forward. Such paddle-based forward feed devices have been found useful for a variety of merchandise.

In the third category, separate dividers and tracks containing pusher paddles are usually employed, along with end dividers to separate the merchandise into columns. It is advantageous to provide an integrated track and divider system, because an integrated track and divider makes assembly of a merchandising system on a shelf easier for store personnel as there are less components to handle. However, an integrated track and divider is disadvantageous from the perspective that the divider cannot be removed from the track, should that become necessary. In some circumstances, a drop in track is desired for wider merchandise so that two pusher paddles urge the merchandise forward. Currently, a separate track has to be produced for this purpose. It would be advantageous to provide a two-part track and divider assembly in which the divider can be selectively separated from the track or connected thereto. In other words, it would be desirable to provide a connection structure to selectively engage the divider with the track or disengage the divider from the track, as may be required in a particular merchandising environment. Further, if there are rails on which the pusher rides, which rails extend above the surface of the track, the base second side of the integrated base and divider assembly also needs to include such rails or be thicker, so that the product packages do not become canted as they are urged forward by the pusher.

Accordingly, it has been considered desirable to develop a new and improved base and divider assembly in which the divider can be selectively separated from the base or reconnected to the base as may be required for a particular merchandising environment.

BRIEF SUMMARY OF THE DISCLOSURE

In accordance with one embodiment of the present disclosure, a base and divider assembly comprises a base portion and a divider portion that protrudes from the base portion. The divider portion includes a first connection element and the base portion includes a second connection element which selectively cooperates with the first connection element so that the divider portion can be selectively mounted to the base portion.

In accordance with another embodiment of the present disclosure, a base and divider assembly comprises an elongated base portion and an elongated divider portion which is adapted to be selectively coupled to the base portion. The divider portion includes a plurality of spaced first connection elements extending along a longitudinal axis of the divider portion, and the base portion includes a plurality of spaced second connection elements extending along the longitudinal axis of the base portion. The first and second connection elements are adapted to cooperate so that the divider portion can be selectively mounted to the base portion.

BRIEF DESCRIPTION OF THE DRAWINGS

The present disclosure may take physical form in certain parts and arrangements of parts, several embodiments of which will be described in detail in this specification and illustrated in the accompanying drawings which form a part hereof and wherein.

DETAILED DESCRIPTION

Figure 1:
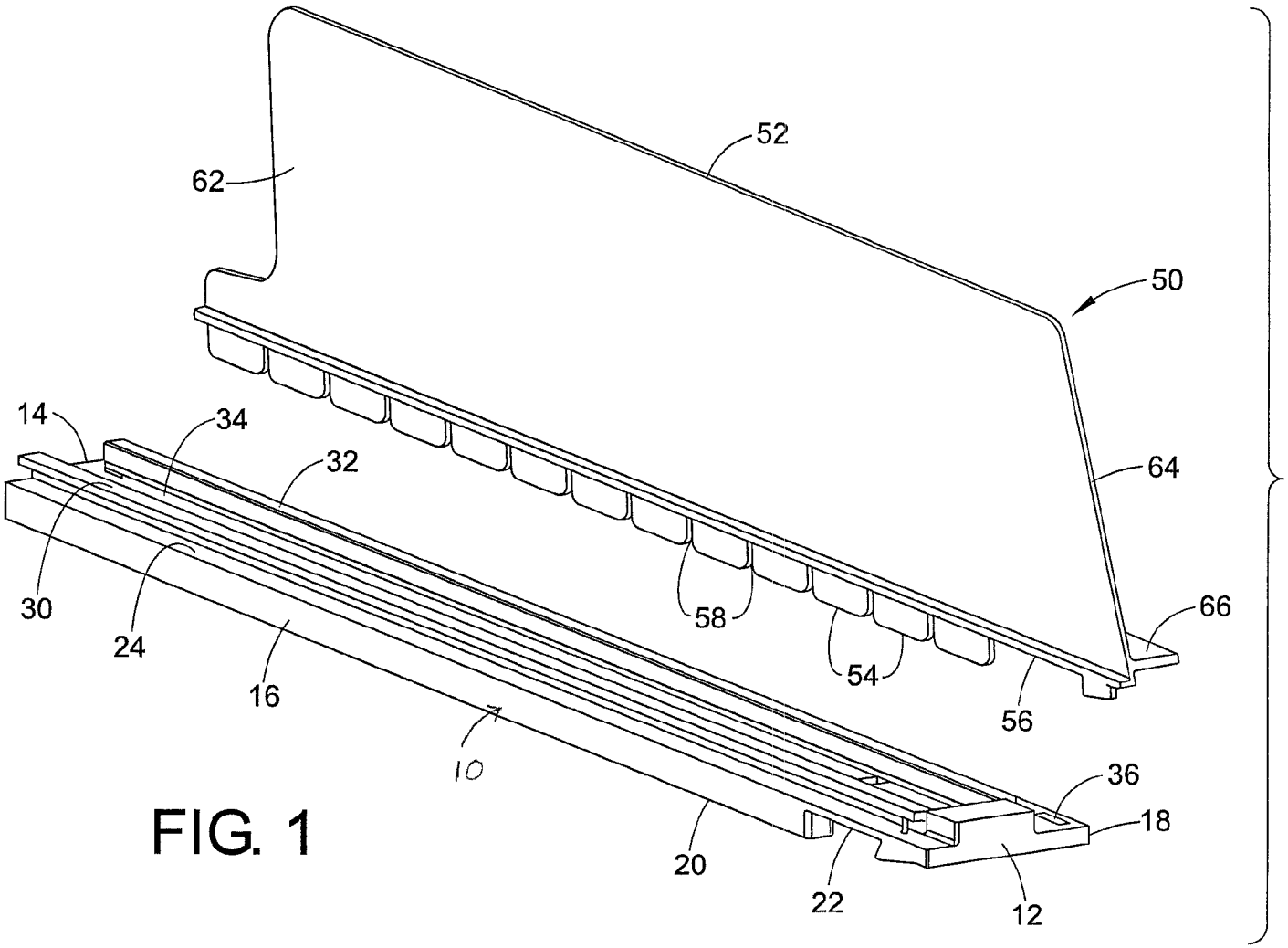
FIG. 1 is an exploded perspective view of a base and divider assembly according to a first embodiment of the present disclosure.

Referring now to the drawings wherein the showings are for purposes of illustrating several embodiments of the disclosure only and not for purposes of limiting same, FIG. 1 shows a first embodiment of a base and divider assembly which includes a base member 10. The base member comprises front and rear ends 12 and 14 and a pair of opposed side walls 16 and 18. A bottom wall 20 includes a transversely extending slot 22 which is located adjacent the front end 12 of the base 10. Protruding from a top wall 24 of the base are a pair of spaced rails 30 and 32. The rails extend along a longitudinal axis of the base and define a channel 34 between them. The pair of spaced rails 30 and 32 and the channel 34 disposed between them define a track on the base 10. The track accommodates a pusher assembly as will be described hereinbelow.

Figure 3:
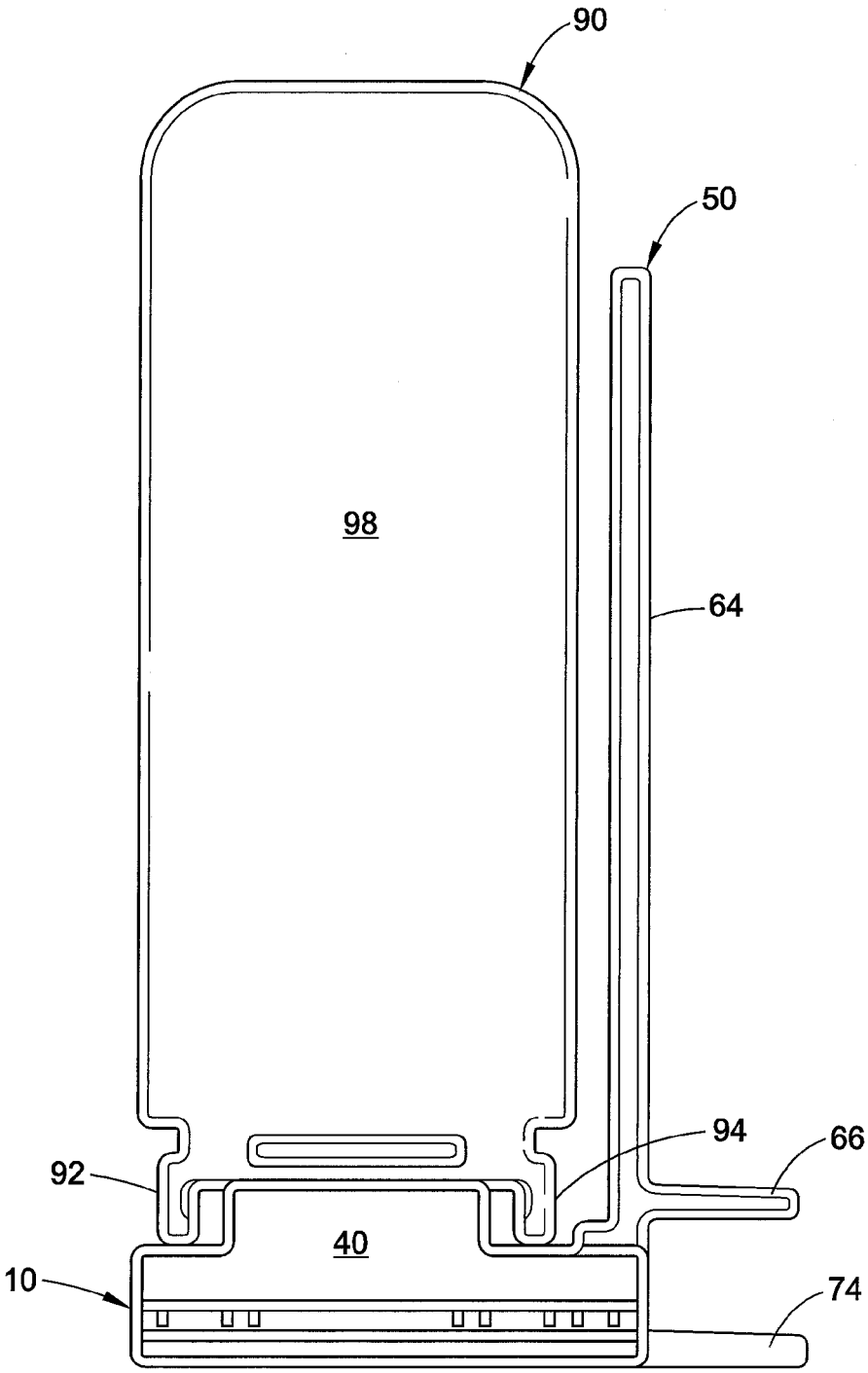
FIG. 3 is an enlarged front elevational view of the base and divider assembly of FIG. 2 in an assembled condition.
Figure 4:
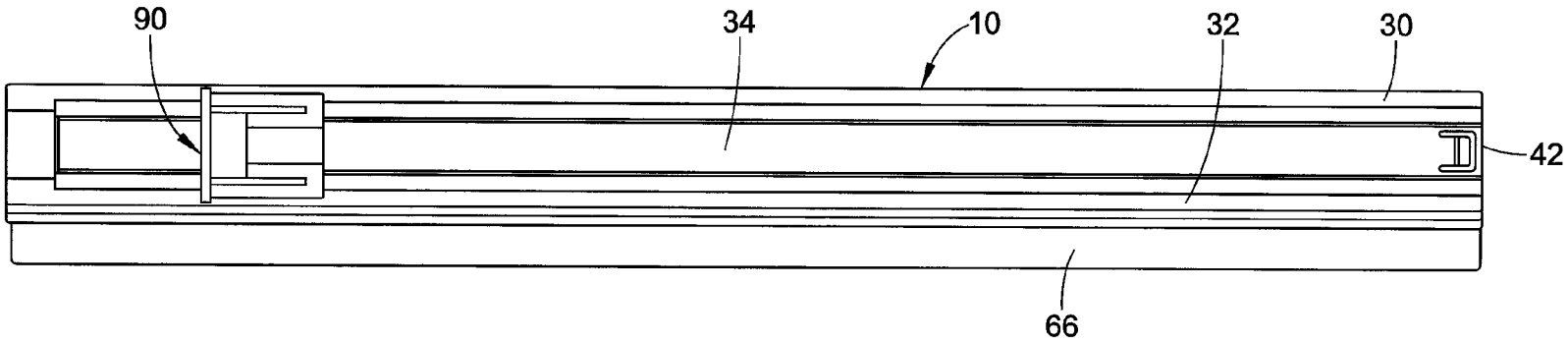
FIG. 4 is a reduced top plan view of the base and divider assembly of FIG. 2 in an assembled condition.
Figure 6:
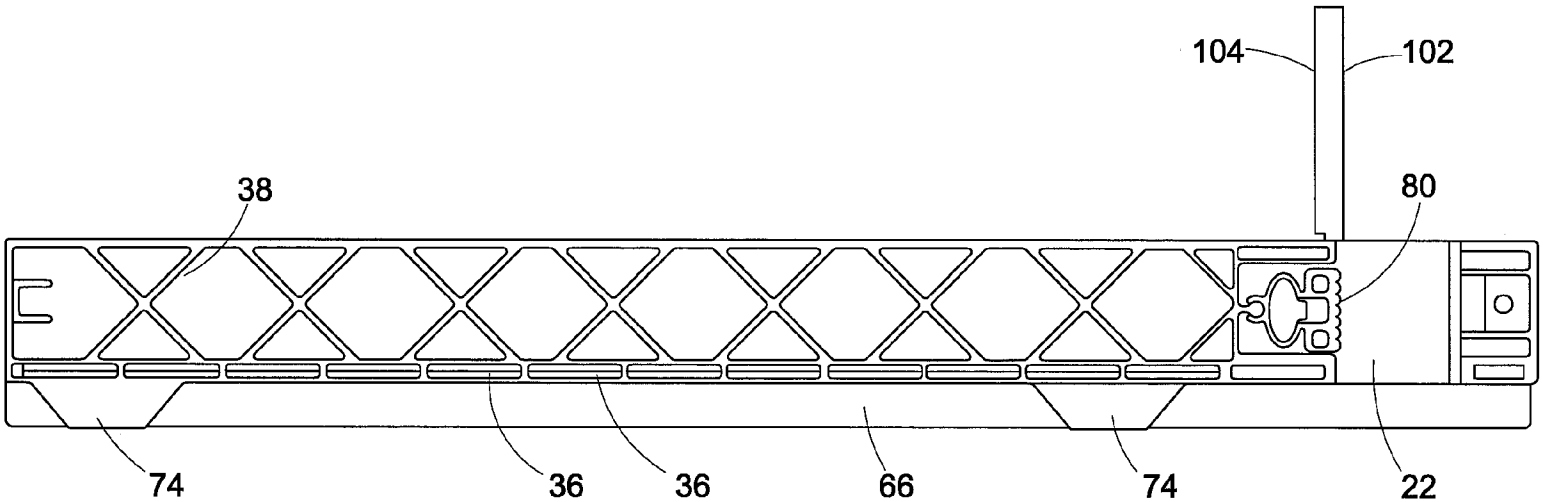
FIG. 6 is a reduced bottom plan view of the base and divider assembly of FIG. 5.

With reference now also to FIG. 6, disposed on the base are a plurality of longitudinally spaced slots 36. In this embodiment, the slots 36 are located adjacent the second rail 32. Also evident from FIG. 6 is that a plurality of reinforcing ribs 38 can extend along the bottom face or wall 20 of the base 10 to stiffen the base. As shown in FIG. 3, a front stop 40 is provided at the front end of the channel 34. With reference now to FIG. 4, a rear stop 42 is also provided at a rear end of the channel 34. In this way, the pusher assembly is limited in its travel so that it does not fall off the track.

Selectively connected to the base is a divider or dividing wall 50 (FIG. 1) that is generally planar in nature and includes a top edge 52 and a bottom edge defined by a plurality of spaced fins, protrusions or teeth 54 protruding from a bottom surface 56. Each pair of fins is separated by a slot or gap 58 in this embodiment. The divider includes a first side 62 and a second side 64. Protruding from the second side is a flange 66. The flange may extend at a generally 90° angle from the divider second side. The relationship between the top side of the flange 66 and the upper surfaces of the two rails 30 and 32 is such that they are generally coplanar. This relationship is further explained in U.S. patent application Ser. No. 13/625,332 filed on Sep. 24, 2012. The subject matter of that application is incorporated hereinto by reference in its entirety.

Figure 2:
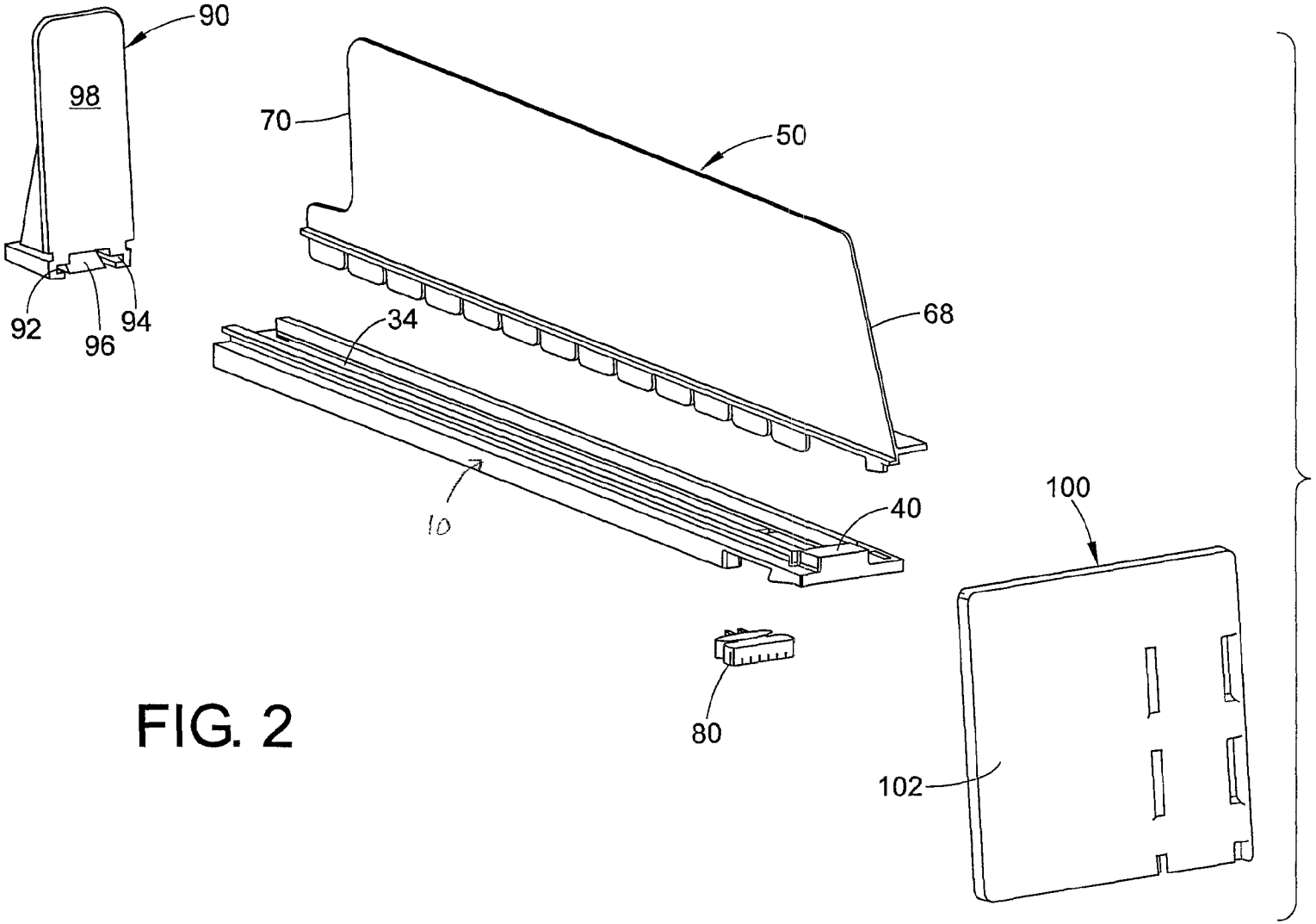
FIG. 2 is an exploded perspective view of the base and divider assembly of FIG. 1 on a reduced scale, with additional components, including a pusher paddle and a paddle extender, as well as a resilient locking construction for selectively securing the base and divider to a front rail mounted on a shelf, wherein the front rail and the shelf are not illustrated for simplicity.

As shown in FIG. 2, the divider also includes a front edge 68 and a rear edge 70. It is noted that the rear edge can be shaped differently from the front edge. The reason for this is that the rear end of the divider does not have to extend all the way to the back of an associated shelf because the pusher only travels rearwardly until it bottoms out on the rear track stop 42.

Provided on the base 10 is at least one extension portion 74 or foot which protrudes away from a remainder of the base. Two such portions 74 are illustrated in the embodiment of FIG. 6. These serve to stabilize the base and give it a wider footprint while at the same time saving on material.

With reference now again to FIG. 2, a resilient locking element 80 can be mounted in the base adjacent the transverse slot 22, as also shown in FIG. 6. A complete description of the interaction between the locking element and a front fence (not illustrated herein for sake of simplicity) can be found in U.S. Patent Publication No. US 2008/0017598. The subject matter of that publication is incorporated hereinto in its entirety.

Selectively mounted on the track 10 is a pusher assembly 90, as shown in FIG. 3. The pusher assembly includes a base portion comprising a pair of protrusions 92 and 94 which engage the rails 30 and 32 to ride thereon. Also depending from the base portion of the pusher assembly 90 is a central protrusion 96 (see FIG. 2) which rides in the channel 34 defined between the first and second rails 30 and 32. Supported on the base of the pusher assembly 90 is a pusher plate 98. Forward movement of the pusher assembly 90 is limited by the presence of the front stop 40 at the front end of the base 10. As mentioned, and with reference now to FIG. 4, a rearward movement of the pusher 90 is limited by the presence of the rear stop 42 on the base.

As is well known in the art, a spring or the like biasing member is provided (not illustrated for the sake of simplicity) so as to urge the pusher assembly forward on the track. The spring can be a coil spring having a front end mounted to the base adjacent the front stop 40 and having a coiled rear portion thereof being supported by the pusher assembly 90. The operation of the coil spring to urge the pusher assembly forward on the track is more fully described in U.S. Pat. No. 7,784,623, the subject matter of which is incorporated hereinto in its entirety.

Figure 5:
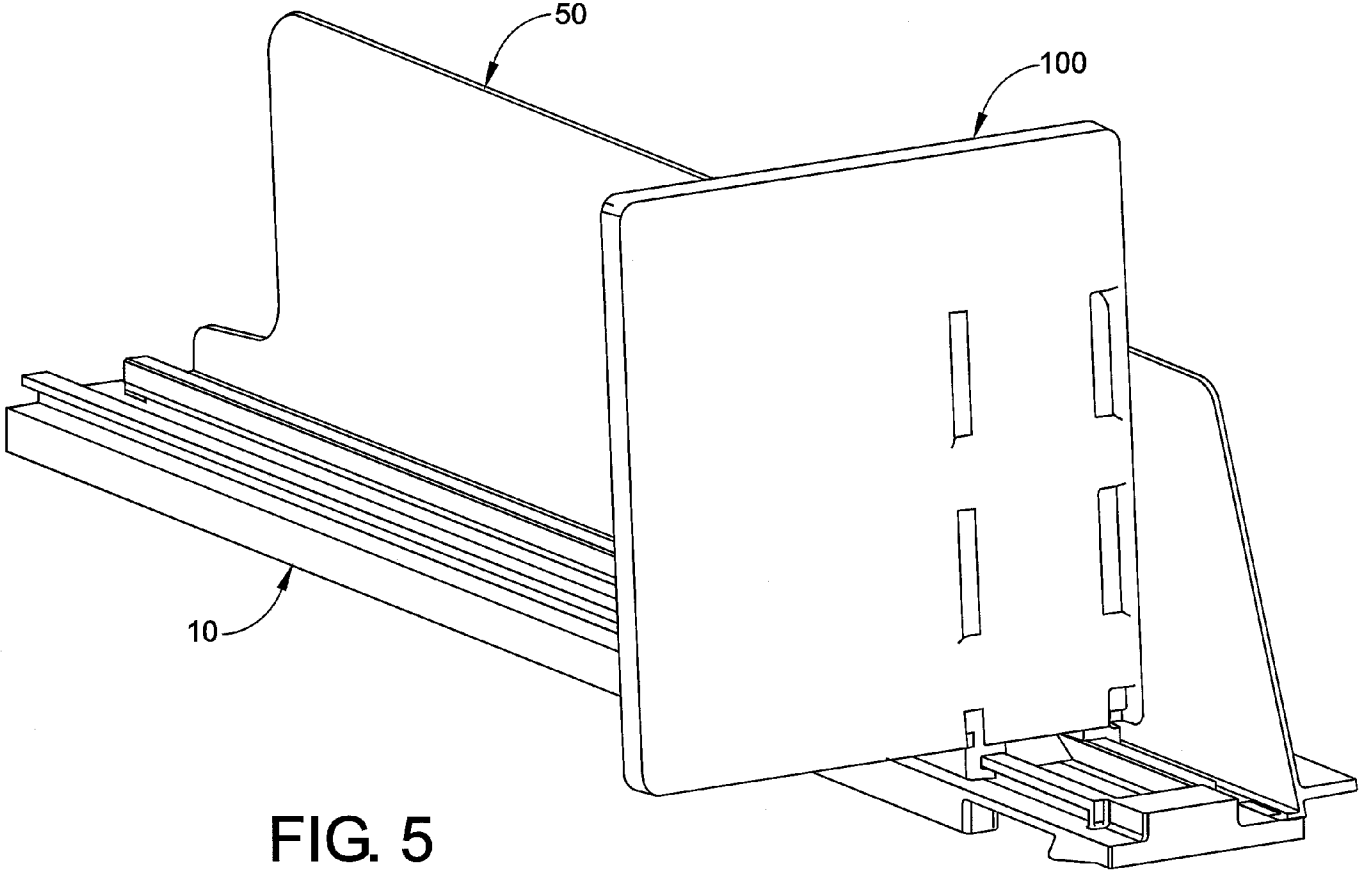
FIG. 5 is an enlarged perspective view of the base and divider assembly of FIG. 2 in an assembled condition with the paddle extender being connected to the paddle.
Figure 7:
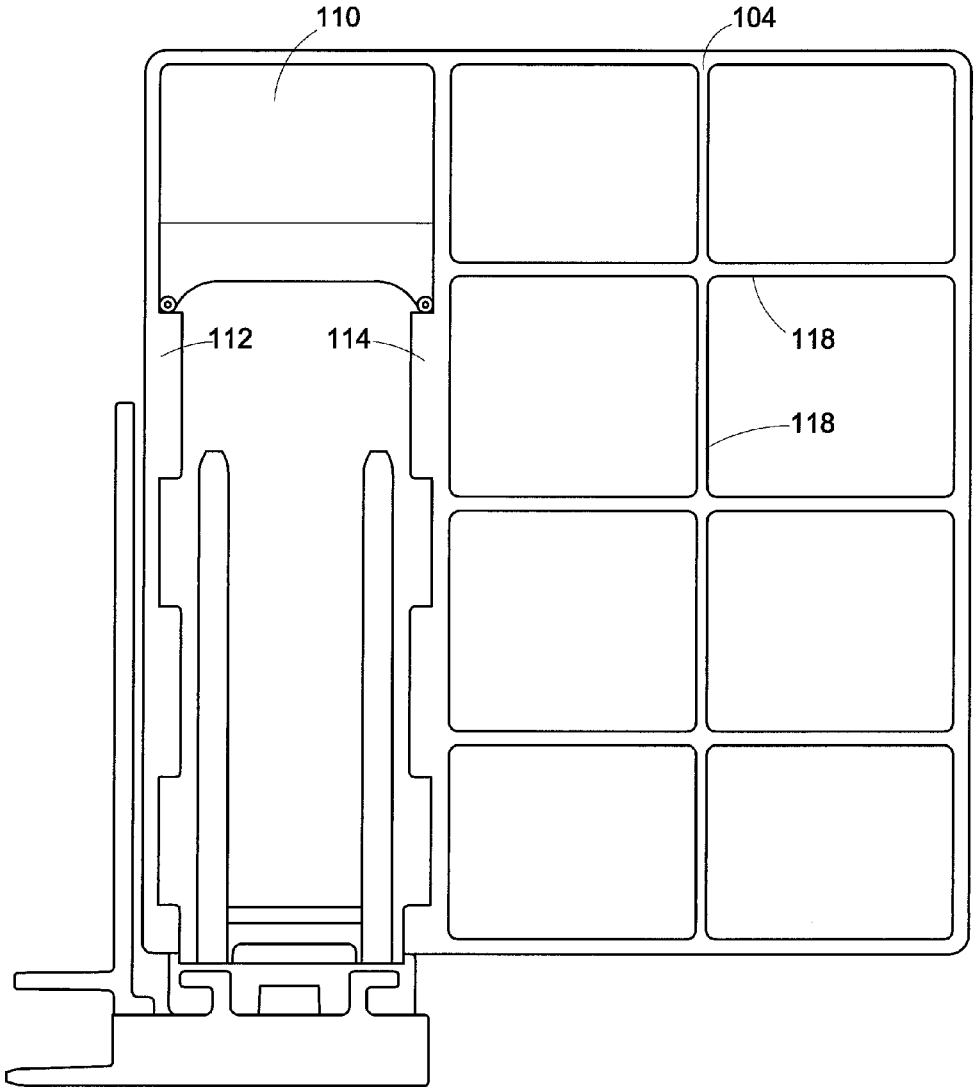
FIG. 7 is an enlarged rear perspective view of the base and divider assembly of FIG. 5.

As shown in FIG. 5, a second plate or extender plate 100 can be selectively mounted onto the pusher plate 98 in order to increase the width of the pusher assembly 90 so as to accommodate wider product being urged forwardly on a shelf. The extender plate 100 includes a front face 102 and a rear face 104 (see FIG. 6). With reference now to FIG. 7, located on the rear face of the extender plate 100 is a channel 110 defined by opposed flanges 112 and 114 which are spaced far enough apart so as to accommodate the opposed sides of the pusher plate 98. Two or three such flanges can be employed on each side of the channel if so desired. It is also apparent that the extender plate rear face 104 can be provided with stiffening ribs 118. In contrast, the front faces of both the pusher plate 98 and the extender plate 100 are preferably generally planar so that products in the column of merchandise being urged forwardly by the pusher assembly 90 are not canted by the action of the pusher plate or the extender plate.

Figure 8:
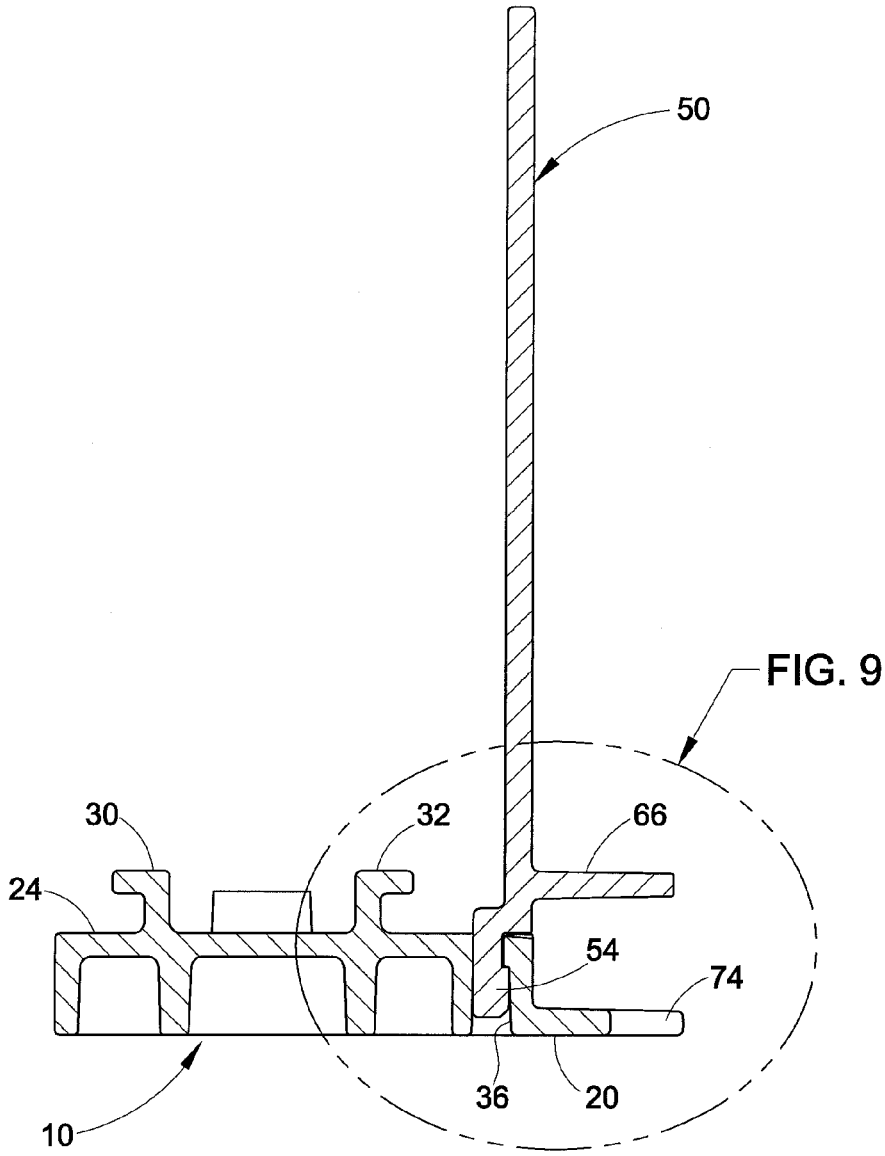
FIG. 8 is an enlarged cross sectional view of an assembled version of the base and divider assembly of FIG. 1.

With reference now to FIG. 8, one embodiment of a connection joint between the divider 50 and the base 10 is there illustrated. In this embodiment, the one or more slots 36 defined on the base 10 accommodate the one or more fins 54 defined on the divider 50. It is apparent that the one or more slots 36 extend generally vertically through the body of the plate from the top face or top wall 24 thereof to the bottom face or wall 20 thereof. Also, the one or more slots 36 and the one or more fins 54 can extend along a longitudinal axis of the base 10 and divider 50, respectively, as illustrated in FIGS. 1 and 6.

Figure 9:
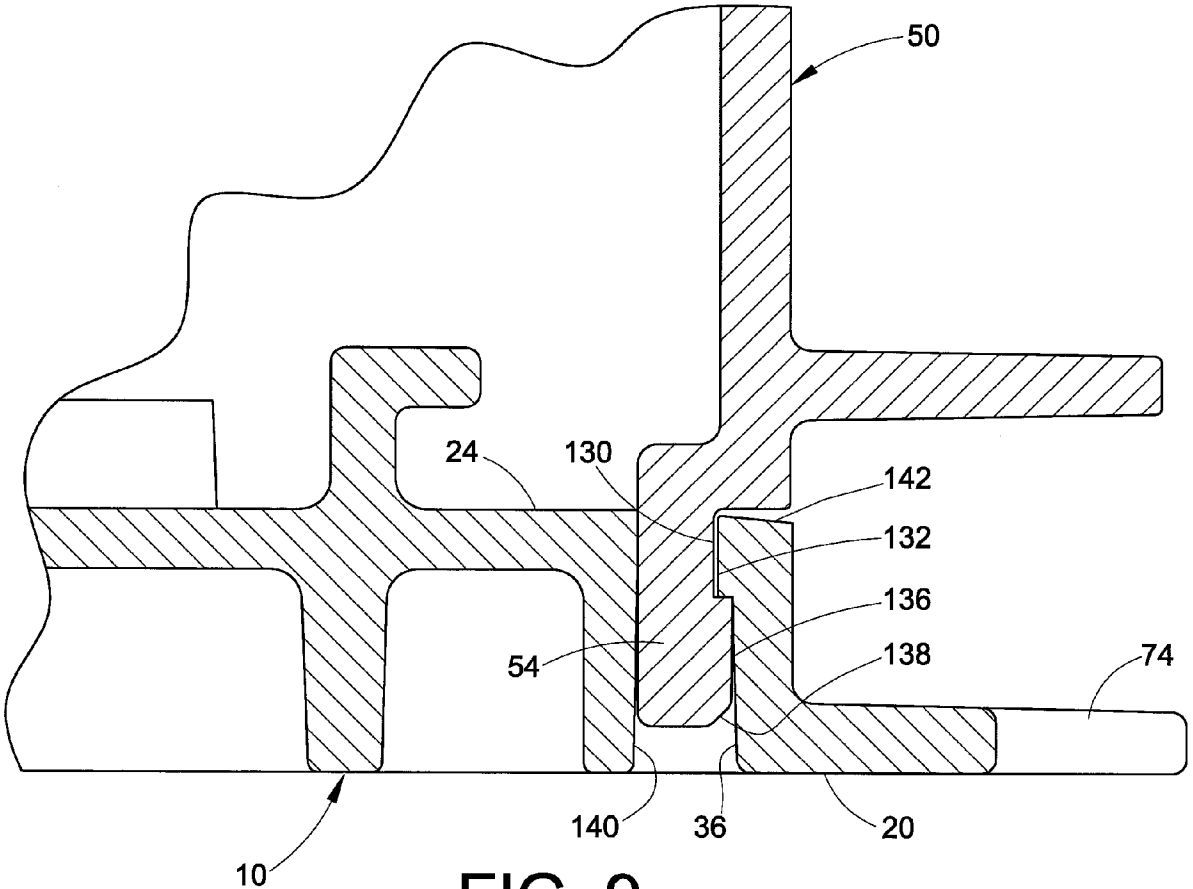
FIG. 9 is a greatly enlarged cross sectional view of a portion of the base and divider assembly of FIG. 8.

With reference now to FIG. 9, protruding into the slot 36 is an enlarged portion or tooth 130 of the base. This enlarged portion of the base cooperates with a slot or channel 132 defined in the one or more fins 54. The remainder of the fin is thicker, thus providing an enlarged section or tooth 136 which extends beneath the enlarged portion 130 of the base. Put another way, the divider has protruding ramps on the serrated teeth which are wider than the opening on the track. In this way, a locking feature is provided for selectively securing the divider 50 to the base 10.

Due to the resiliency of the thermoplastic material from which at least one of the divider 50 and the base 10 are made, the divider can be selectively separated from the base and be selectively connected thereto any desired number of times within reason. In other words, the opening on the track or base has an undercut or draft angle on it and the fins of the divider can snap into the base. Thus, a generally snap fit arrangement is provided in this embodiment of the base and divider assembly.

The number of fins 54 and slots 36 can be varied to suit the particular requirements of the merchandising installation in which the base and divider assembly are meant to be used. In one embodiment, ten or more such cooperating fins and slots can be provided. However, in other embodiments, more or less than that number of cooperating fins and slots can be employed.

With continued reference to FIG. 9, it is apparent that a tapered section 138 is provided adjacent a distal end of the fin 54. Further, the slot 36 tapers outwardly towards the bottom wall or surface 20 of the base. In this way, insertion and removal of the fin 54 into the slot 36 can be more easily accomplished. It is also noted that the base top surface 24 has an angled portion 142 located beneath the bottom face of the divider 50 in order to avoid any tolerance problems between the divider bottom face and the base top face. For the disclosed embodiment, the tolerances can be on the order of plus or minus 0.003 inches or so. The divider can be separated from the track and rejoined thereto any number of times, within reason, because the outer wall of the opening of the track deflects outward when the divider is pressed in and deflects back to its regular position when the divider is seated.

Figure 10:
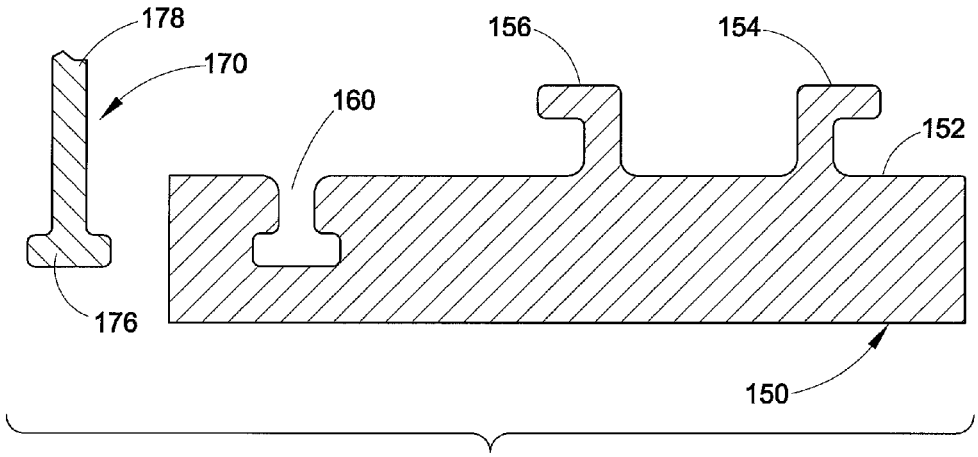
FIG. 10 is a schematic exploded cross-sectional view of a base and divider assembly according to another embodiment of the present disclosure.

In an alternate embodiment, other types of connecting structures can be used to selectively join the divider to the base. For example, the divider, rather than being snap fit to the base can be selectively slid onto the base and selectively slid off the base. With reference now to FIG. 10, a connecting structure that employs a sliding connection between a divider and a base is there illustrated. In this embodiment, there is provided a base 150 including a top surface 152 extending from which are a pair of spaced rails 154 and 156. Located adjacent the second rail 156 and extending into the base 150 is a slot 160. The slot can extend longitudinally in parallel with the rails 154 and 156, if so desired. As is evident from FIG. 10, the slot has a generally upside down T-shape so that it is wider at its bottom than at its top. The slot accommodates a cooperating portion of a divider 170. More particularly, the divider includes an upside down T-shaped base 176 which can be selectively inserted into the slot 160 when it is desired to connect the divider to the base. Extending upwardly from the base 176 is a divider wall 178 which serves to divide merchandise into columns on the shelf on which the base and divider assembly is used.

Figure 11:
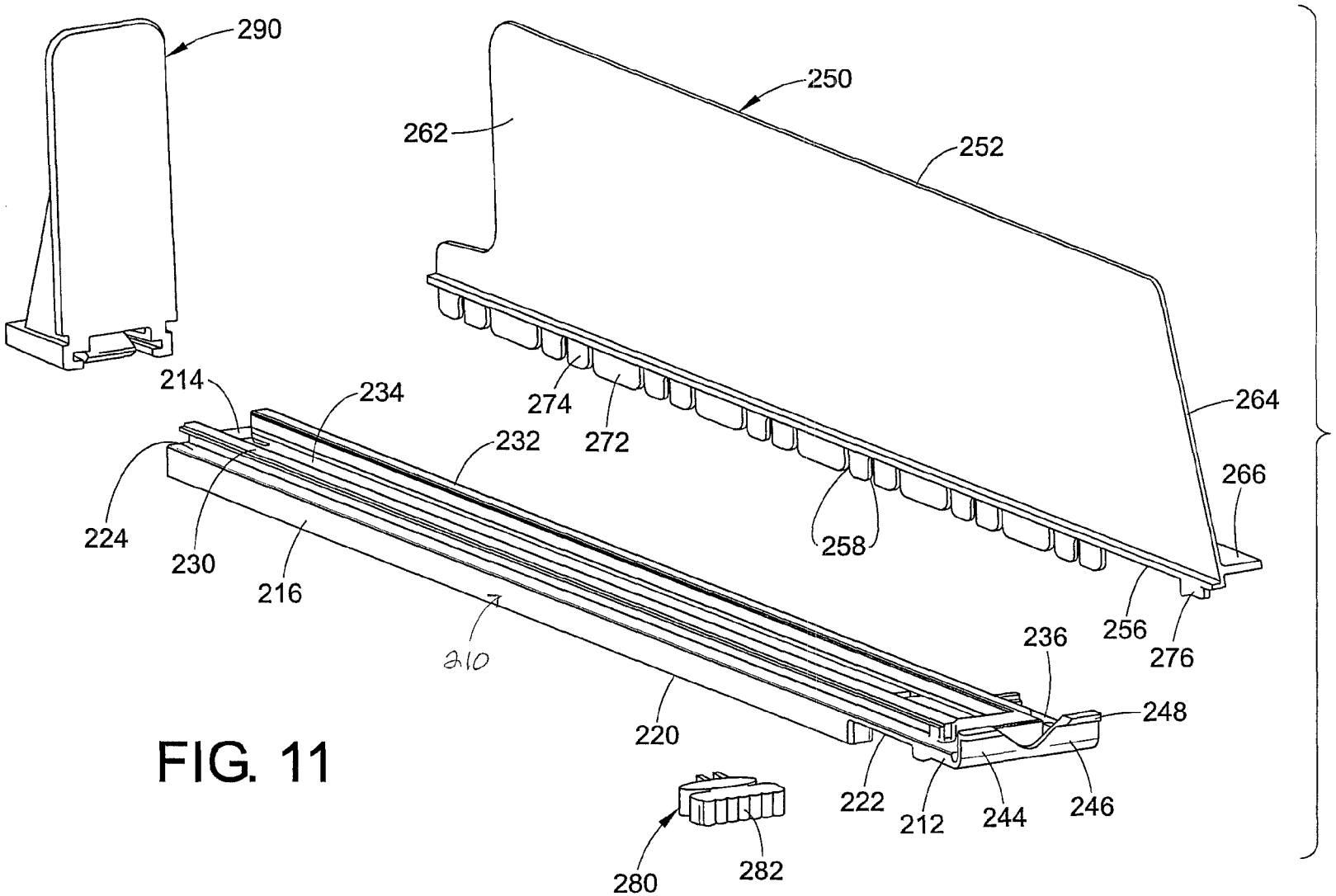
FIG. 11 is an exploded perspective view of a base and divider assembly according to a further embodiment of the present disclosure.
Figure 12:
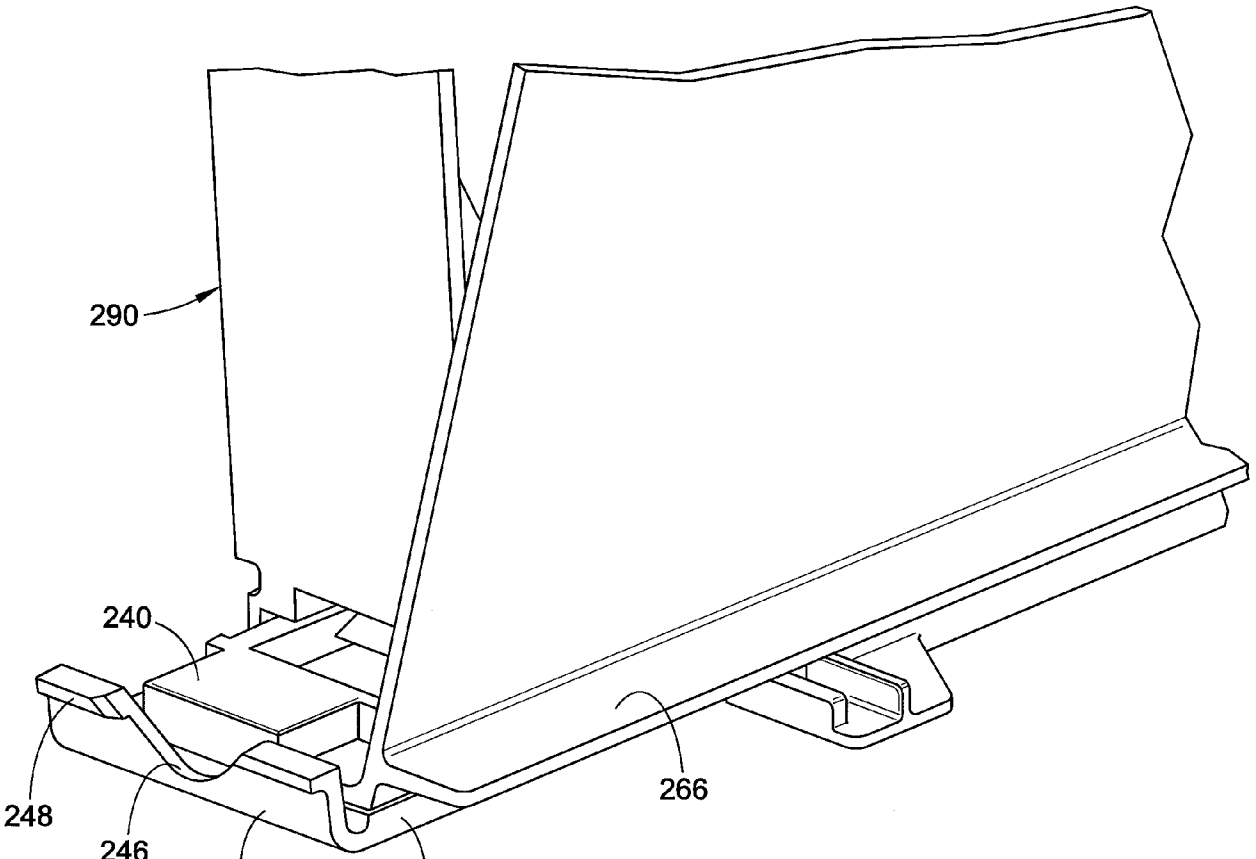
FIG. 12 is an enlarged assembled perspective view of the base and divider assembly of FIG. 11.
Figure 13:
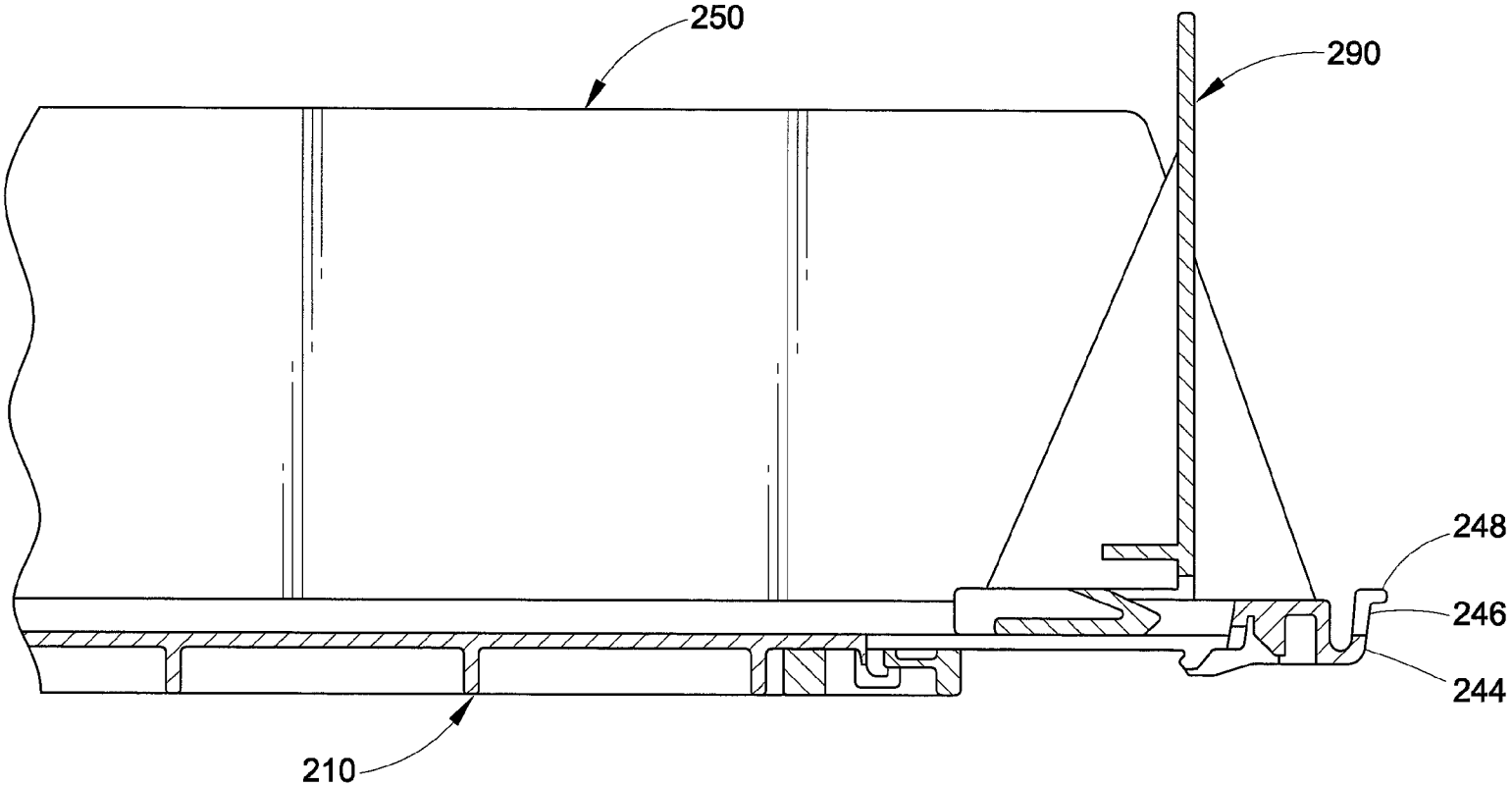
FIG. 13 is a side elevational view in cross section of the base and divider assembly of FIG. 12.
Figure 14:
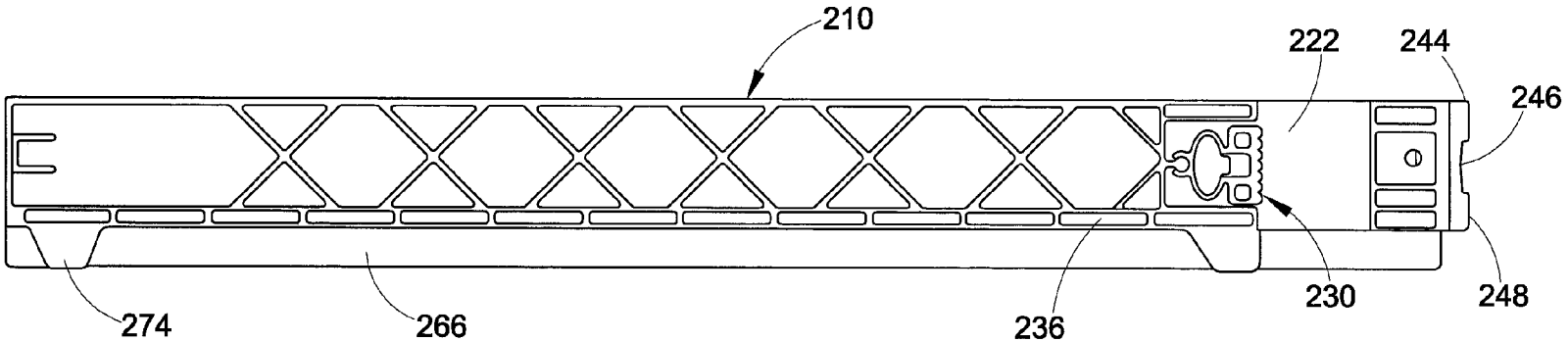
FIG. 14 is an assembled bottom plan view of the base and divider assembly of FIG. 11.

A further embodiment of the present disclosure is illustrated in FIG. 11. In this embodiment, there is provided a base member 210 which comprises a front end 212 and a rear end 214, as well as opposed side walls, including a first side wall 216 and a second side wall (not visible). A bottom wall 220 includes a transversely extending slot 222 which is located adjacent the front end 212 of the base 210. Protruding from a top wall 224 of the base are a pair of spaced rails 230 and 232. The rails extend along a longitudinal axis of the base and define a channel 234 between them. The rails define a track which accommodates a pusher assembly 290. With reference now also to FIG. 14, a plurality of spaced slots 236 are provided on the base. A front stop 240 is provided at the front end of the channel 234 in order to limit the forward travel of the pusher assembly.

Selectively connected to the base is a divider or dividing wall 250. The dividing wall is generally planar in nature and includes a top edge 252 and a bottom edge defined by a plurality of spaced fins or like protrusions. In this embodiment, there is provided a long fin or tooth 272, as well as a short fin or tooth 274. These are spaced from each other by respective slots 258. Also provided is a front tooth or fin 276 which is spaced apart from the other teeth or fins. The divider includes a first side 262 and a second side 264. Protruding from the second side is a flange 266. The flange may extend at a generally 90 degree angle from the divider second side. The relationship between the top side of the flange 266 and the upper surfaces of the two rails 230 and 232 is such that they are generally coplanar.

Provided on the base is at least one transverse extension portion 274 or foot. Two such portions 274 are illustrated in FIG. 14. They serve to stabilize the base and give it a wider footprint, while at the same time saving on material. With reference again to FIG. 11, a resilient locking element 280 can be mounted in the base adjacent the transverse slot 222. Also provided is a movable pusher 290. The pusher 290 can be biased by any form of biasing element, such as a coil spring, as is known in the art.

In this embodiment, the base 210 is provided with a front lip 244 protruding forwardly from the base front end 212. The front lip is resiliently mounted to the remainder of the base so that it can flex somewhat as may be needed when the base is mounted to or detached from a front rail. With this embodiment, the track and selectively separable divider can be simply snapped into a front rail. If the front rail is provided with teeth, they can engage the respective teeth 282 of the base locking element 280. The recess 246 in the lip 244 is advantageous to allow a digit of the installer to more easily grasp the lip and snap the base into a front rail.

Figure 15:
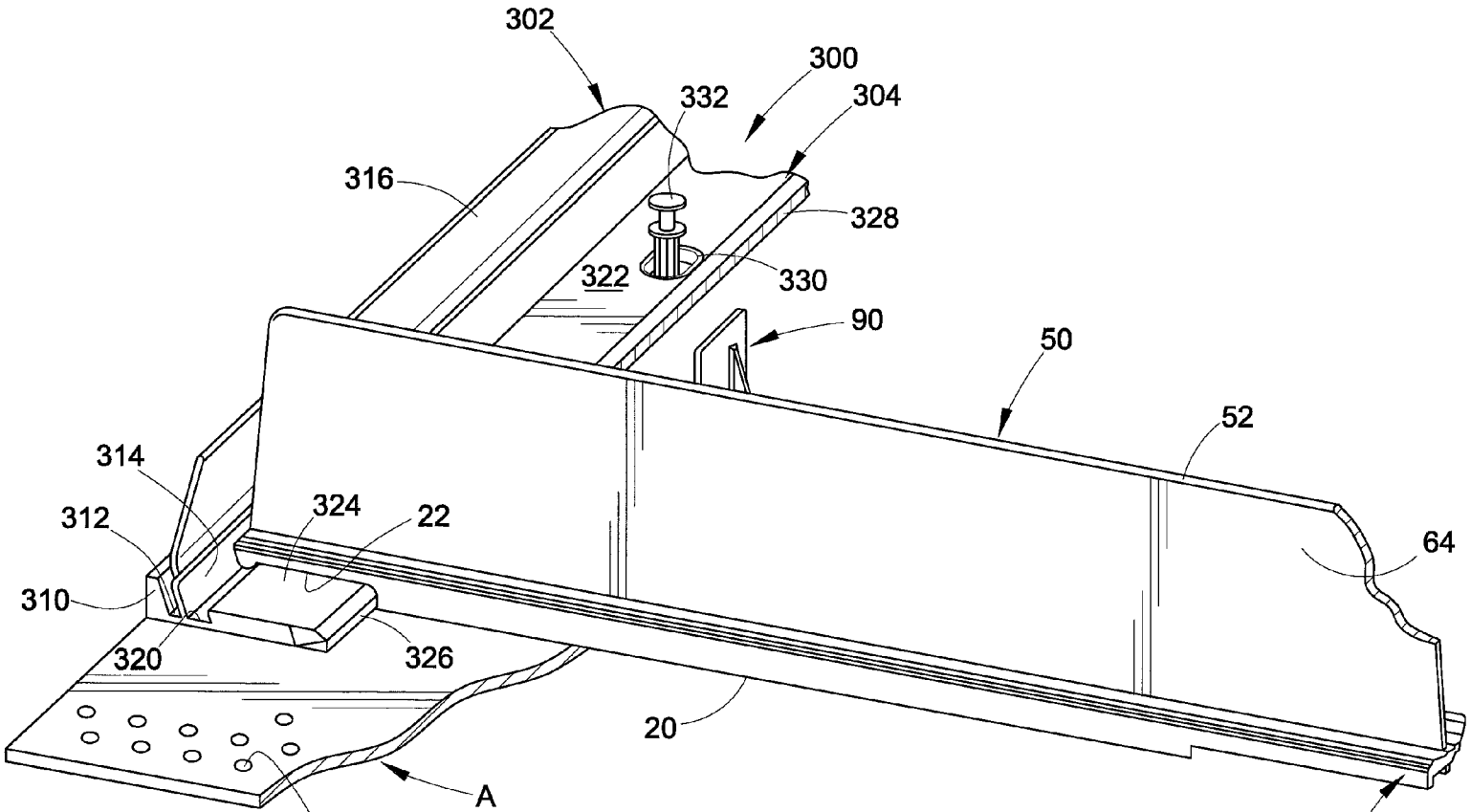
FIG. 15 is an assembled perspective view of the divider and base assembly of FIG. 1 mounted to a front rail which, in turn, is mounted on a shelf.

With reference now to FIG. 15, a front rail 300 can be mounted on a shelf A and used with any of the track and divider assemblies shown herein. More particularly, and with reference also to FIG. 1, the base 10 is mounted to the front rail and the divider 50 selectively mounted to the base. In this embodiment, the front rail includes a vertical portion 302 and a horizontal portion 304. The vertical portion can comprise a first section 310 which is separated by a slot 312 from a second section 314. A fence 316 can be selectively inserted in the slot. The front rail horizontal portion can include a slot 320 and a plateau 322. The plateau includes a top surface 324 and a rear surface 326 which can be provided with a plurality of teeth 328. An opening 330 can be provided in the plateau for accommodating a fastener 332 which extends through the front rail and into a selected aperture 334 of the shelf A. The teeth 328 can cooperate with the teeth disposed on locking element 80 to selectively connect the base and divider assembly to the front rail and retard a sideward sliding motion of the base and divider assembly in relation to the front rail.

As noted, there can also be other types of connecting structures which selectively connect the base and divider to each other but which allow the base to be separated from the divider when the divider is not needed.

It should be appreciated that the base can include a pusher track. Alternatively, the base can simply support a divider. A pusher track would not be necessary if the base is only used to hold a divider. Moreover, a pusher track may not be necessary if trackless pushers are employed in the merchandising assembly as have recently come into use. Moreover, if a pusher track is provided, the pusher track can be provided either on the base or on the divider, as is known in the art.

In one embodiment of the present disclosure, the divider would be separated from the base so that the base, and the track on it, can be used as a separate drop in track in order to help push larger products. In other embodiments, the divider is coupled to the base so that a single assembly can provide both a dividing function and a pushing or urging function for products being held on a shelf.

Disclosed has been a display system which includes a base and divider assembly for supporting displayed merchandise, wherein the base and divider assembly includes a base portion which is adapted for operative coupling to a shelf and a divider portion for dividing the displayed merchandise into columns. The divider portion protrudes from the base, such that the divider portion separates the base into a first portion and a second portion. Defined on the base first portion is a pusher track. A spring urged pusher is connected to the pusher track for urging merchandise towards the front of an associated shelf. The divider is detachably connected to the track so that it can be selectively disengaged from the pusher track should that become necessary. Also, the divider can be reengaged with the pusher track when that is required. A coupling construction is provided for this purpose.

The disclosure has been described with reference to several embodiments. Obviously, modifications and alterations will occur to others upon a reading and understanding of the preceding detailed description. It is intended that the disclosure be construed as including all such modifications and alternations in so far as they come within the scope of the appended claims or the equivalents thereof

What is claimed is:

1. A base and divider assembly comprising:

a base portion;

a divider portion that protrudes from the base portion wherein the divider portion extends longitudinally along a vertically oriented central plane;

wherein the divider portion includes at least one first connection element and the base portion includes at least one second connection element which selectively cooperates with the at least one first connection element so that the divider portion is adapted to be selectively mounted to the base portion;

wherein the at least one first connection element includes at least one protrusion having a channel spaced from a leading edge thereof, and the at least one second connection element includes at least one slot having a tooth at a leading edge thereof, said tooth adapted to cooperate with said channel to interlock the base portion with the divider portion when the at least one first connection element is received in the at least one second connection element; and wherein the at least one first connection element and the at least one second connection element are spaced from the central plane and are aligned with each other and extend along a vertical plane parallel to the central plane.

2. The assembly of claim 1 wherein a pusher track is defined on the base portion and a pusher is mounted to the pusher track.

3. The assembly of claim 1 wherein the divider portion is disposed adjacent a side edge of the base portion.

4. The assembly of claim 1 wherein the protrusion comprises a proximal section having a first thickness and a distal section having a second thickness which is greater than said first thickness.

5. The assembly of claim 4 wherein the at least one protrusion comprises a plurality of protrusions and the at least one slot comprises a plurality of slots, the plurality of protrusions of the divider portion extend into respective ones of the plurality of slots in the base portion.

6. The assembly of claim 5 wherein the plurality of slots extend along an axis parallel to a longitudinal axis of the base portion.

7. The assembly of claim 5 wherein the plurality of protrusions comprise at least one long protrusion and at least one short protrusion.

8. The assembly of claim 1 wherein the protrusion snap fits into the slot with the tooth interlocking with the channel.

9. A base and divider assembly comprising:

an elongated base portion;

an elongated divider portion adapted to be selectively coupled to the base portion, wherein the divider portion extends longitudinally along a vertically oriented central plane; and wherein the divider portion includes a plurality of spaced first connection elements extending along a longitudinal axis of the divider portion and offset from a first side and a second side of the divider portion, and the base portion includes a plurality of spaced second connection elements extending along a longitudinal axis of the base portion, wherein the first and second connection elements are adapted to cooperate so that the divider portion can be selectively mounted to the base portion, wherein a contact surface of the base portion and aligned with the vertically oriented central plane located beneath the divider portion is tapered in a direction perpendicular to the vertically oriented central plane.

10. The assembly of claim 9 wherein a pusher track is defined on the base portion and a pusher is mounted to the pusher track.

11. The assembly of claim 9 wherein the divider portion is disposed adjacent a side edge of the base portion.

12. The assembly of claim 9 wherein the first connection element comprises a protrusion.

13. The assembly of claim 12 wherein the second connection element comprises a slot into which said protrusion is adapted to extend.

14. The assembly of claim 13 wherein the protrusion comprises a proximal section having a first thickness and a distal section having a second thickness which is greater than the first thickness, the proximal section defining a channel.

15. The assembly of claim 14 wherein the slot comprises a proximal section having a first width and a distal section having a second width which is greater than the first width, wherein the proximal section defines a tooth.

16. The assembly of claim 15 wherein the protrusion snap fits into the slot with the tooth being received in the channel to restrict separation of the base portion from the divider portion.

17. The assembly of claim 9 wherein the base portion includes a front lip adapted to contact a portion of an associated rail when the base portion is mounted to the associated rail.

18. The assembly of claim 17 wherein the front lip is resiliently mounted to a remainder of the base portion.

19. The assembly of claim 17 further including a recess disposed in the front lip adapted for accommodating a digit of a person installing the base portion on the associated rail.

20. The assembly of claim 9 wherein the plurality of first connection elements comprise at least one long protrusion and at least one short protrusion.

* * * * *